United States Patent [19]

Pastorelli et al.

[11] 4,124,420

[45] Nov. 7, 1978

[54] METHOD AND A DEVICE FOR PROVIDING WOVEN BANDS OR RIBBONS FROM TISSUE WOVEN BY A STANDARD WEAVING MACHINE

[75] Inventors: Dante Pastorelli, Gallarate, (Varese); Giancarlo Saporiti, Cassano Magnago, (Varese), both of Italy

[73] Assignee: Nastrificio Eurotessile S.R.L., Varese, Italy

[21] Appl. No.: 654,952

[22] Filed: Feb. 3, 1976

[30] Foreign Application Priority Data

Oct. 6, 1975 [IT] Italy ..... 27991 A/75
Feb. 5, 1975 [IT] Italy ..... 83608 A/75

[51] Int. Cl.[2] ..... D03D 47/50; B32B 31/00; D03D 49/00

[52] U.S. Cl. ..... 156/88; 139/291 C; 156/148; 156/251; 156/515; 28/170

[58] Field of Search ..... 156/88, 251, 515, 271, 156/148; 139/291 C; 28/1 CS, 72 CS

[56] References Cited

U.S. PATENT DOCUMENTS

| | | | |
|---|---|---|---|
| 1,323,212 | 11/1919 | Bulley | 156/271 |
| 2,327,468 | 8/1943 | Stocker | 156/88 |
| 2,628,412 | 2/1953 | Vera | 156/88 |
| 2,756,819 | 7/1956 | Judelson | 156/88 |
| 3,313,323 | 4/1967 | Calemard | 139/291 C |
| 3,486,957 | 12/1969 | Fish et al. | 156/88 |
| 3,515,623 | 6/1970 | Bates | 139/291 C |
| 3,772,112 | 11/1973 | Lyons | 156/88 |
| 3,961,650 | 6/1976 | Marowsky | 28/1 CS |

FOREIGN PATENT DOCUMENTS

| | | | |
|---|---|---|---|
| 740,926 | 11/1932 | France | 139/291 C |
| 951,930 | 4/1949 | France | 139/291 C |

*Primary Examiner*—Douglas J. Drummond

[57] ABSTRACT

A method and a device for cutting ribbons from a large fabric as provided by any weaving machine wherein the cutting-sealing operation is effected downstream of said weaving machine before the fabric is wound up in bobbins and serially with the production of the fabric which moves through the units carrying out the cutting-sealing operation.

12 Claims, 7 Drawing Figures

FIG.1

METHOD AND A DEVICE FOR PROVIDING WOVEN BANDS OR RIBBONS FROM TISSUE WOVEN BY A STANDARD WEAVING MACHINE

The device according to the present invention relates to the provision of woven bands or ribbons obtained from a fabric of standard height containing at least some threads of heat sealable plastic material. Said fabric can be produced by any weaving machine, such as a shuttle, pliers, pusher, needle, rigid rod and the like weaving machine. Normally, these bands are used as labels which can be applied to garments and carry a manufacturer's mark or other writing or pattern and are usually obtained with wefts of different colours. These bands can be used also for providing trimmings or other similar products.

Hitherto, bands of the type above referred to and particularly labels were produced by using special machines providing a predetermined amount of ribbons having a given width which could usually be varied by effecting some adjustments on the machine. These machines while producing quite satisfactory label bands or ribbons or trimmings from an aesthetical standpoint, suffered from several disadvantages. Firstly, each machine or loom could produce a determined amount of ribbons which was fixed for each determined loom. This led to an incomplete exploitation of the machine where the width of the ribbon strips had to be reduced. Otherwise, the manufacturer was in the need of having a plurality of machines for producing ribbons of different heights, but also in this case it could occur that the desired correct width was not available, or the relative machine was already engaged. Additionally, in case of varying said width of each ribbon, relatively time consuming and complicated adjustment operations had to be carried out, which resulted in machine shutdown and accordingly a further reduction in total output. Finally, for reducing the overall dimensions, ribbon looms cannot provide more than a certain amount of wefts (that is a given amount of colours), which in some case may be inadequate for certain types of more elaborate labels or some more valuable trimmings. Moreover, cop replacement in conventional ribbon machines would involve every time a machine shutdown. Now, in ribbon machines the number of cops is commensurate to that of the wefts multiplied by the number of ribbons; for example, in a machine providing 30 ribbons with 4 colours, the cops would amount to 120. This would involve a machine shutdown whenever one of said 120 cops is depleted. Conversely, in a standard weaving machine the cop replacement would occur only four times, that is once for each weft.

Machines are already known for cutting ribbons from a fabric of a standard height, but such machines cannot be applied to the manufacture of extremely accurate ribbons, such as those that should be used in a label or trimming production. As a matter of fact these machines are unable of cutting ribbons along a same thread, that is while the width of each ribbon can be kept approximately constant, they may have slight side displacements that can be tolerable in a single colored ribbon, but are inacceptable where labels and trimmings are concerned, because this results in an unavoidable and not admissible eccentricity in the pattern forming the trimming or label.

In order to overcome all of these disadvantages, it is provided according to the invention to produce the ribbons forming the labels or trimmings on any weaving machine having the desired number of wefts (for example, up to eight wefts), that is a pattern or writings can be produced as comprising up to eight colors, or in any case eight types of different yarns. The single large fabric so provided, showing many ribbons, is according to the invention cut and simultaneously electrically sealed, so as to form the individual ribbons having the desired pattern.

The invention consists of making these cuts-seals simultaneously with the ribbon manufacture, immediately downstream of the weaving machine, without winding up the fabric on bobbins, but passing it to enlarging and tensioning transmission rollers and winding up the ribbons on bobbins when such ribbons have been already cut.

According to this invention, with a less expenditure and minimal capital investment in machinery, a larger amount of perfect labels from execution standpoint can be produced. Also labor cost is reduced since a single workman or operator can attend to the weaving machine and cutting-sealing apparatus as well as the winding of the ribbons. The individual cutting-sealing units may be provided with a rotary or vibratory motion relative to the fabric, or be stationary.

According to an improvement in the invention, it is provided that the individual cutting-sealing units are carried on a cross bar so as to be slidable thereon, whereby the ribbon width can be very easily adjusted.

According to the invention, the cutting-sealing units can carry out this operation in any way, that is providing a somehow heated blade or wire, although the preferred solution, as hereinafter referred to, will be that in which the cuttin-sealing unit is electrically heated and the temperature thereof is adjusted as desired, so as to accommodate any type of fabric, any cutting rate, etc.

In the particular case of a cutting-sealing unit comprising a thin wire or blade, it is provided according to an improved embodiment of the invention that said wire or blade is connected with a spring device which can be loaded, so that during heating, the wire or blade elongation can be compensated for by the associated spring device.

According to a further improved embodiments of the invention, the power outlet for each of the cutting-sealing units merely comprises a pressure sliding contact, wherein said pressure force is created by a resilient means.

A device was also designed for moving the cross bar carrying the several cutting-sealing units, so that said units can be altogether simultaneously displaced or moved to compensate for any slight cross displacement of the fabric, as the latter is travelling on the several widening or enlarging rollers preceding or upstream of said cutting-sealing units. This device can also be rendered automated by a sensor member sensing the position of a finished fabric selvage or listing at a location upstream of the cutting zone and accordingly adjusting the position of said cross bar.

A further improved embodiment of the invention was obtained by providing that the fabric tension in that length or section where the cutting-sealing operation is carried out is made adjustable through the provision, for example, of adjustable clutches in the tension roller(s).

As a further improvement, a heated roller was also provided as located downstream of the cutting device, preferably just after a cylinder providing a simple fabric tension in the cutting-sealing zone. This heating will produce a kind of ironing on the fabric and improves the obtained ribbons. The temperature for this roller can be made adjustable so as to accomodate any particular processing requirement.

A pair of rollers can also be provided for regulating or timing the cutting position relative to the weaving position. Thus, it has been found convenient that the cutting position should be identical to the weaving position, since in every fabric comprising a certain colored pattern, there are colorless locations or at least comprising a less number of colors, wherein the weaving speed is higher and accordingly the feeding rate is also higher, while at the same time the fabric thickness is lower. In a device according to the present invention, the cutting-sealing speed is always the same as the weaving speed. Therefore, it is preferred that those portions without any colour or having few colors, and hence thinner as a result, should be more speedily cut, that is at the same output rate of the fabric at that location, whereas cutting-sealing operation at a highly coloured and accordingly thicker zone should be more slowly carried out, that is at the same output rate of the fabric at the more coloured location.

This timing between weaving and cutting-sealing positions can be provided in various ways: for example, a pair of movable rollers are provided which can extend or shorten the fabric path or travel between the weaving location and the cutting-sealing location, so that the device according to the present invention can accommodate any type of pattern.

The features of the invention will now be better understood from the following description of some exemplary embodiments that have been quite schematically and unrestrictively shown in the accompanying drawings in which.

Figure 1:
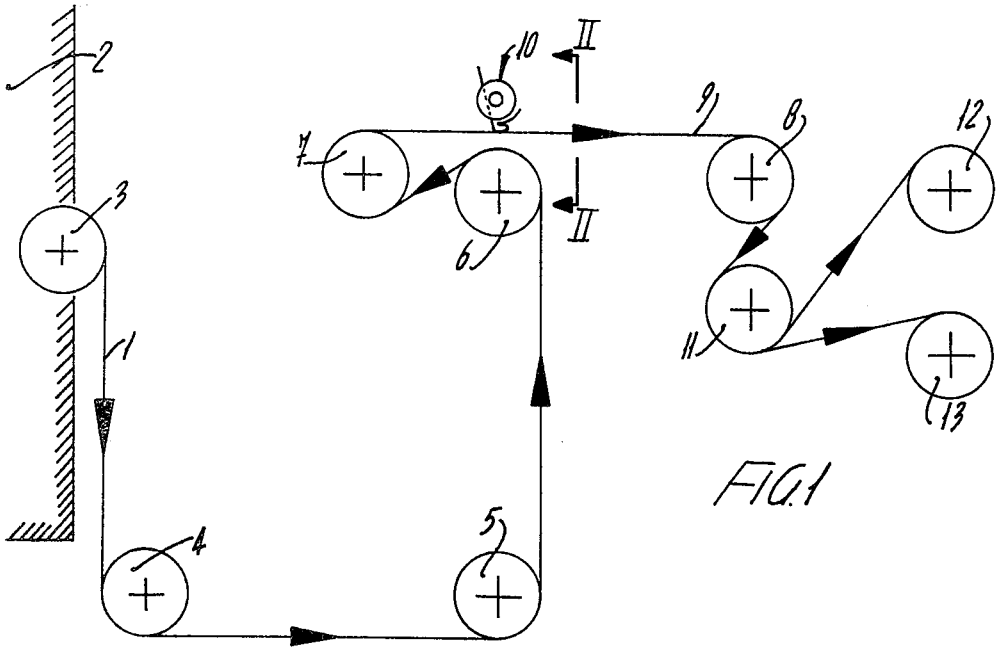
FIG. 1 is a schematic side view showing the entire path or travel for the fabric according to a simplified solution of the process according to the present invention.

Referring first to FIG. 1, a fabric 1, as provided by any type of weaving machine or loom 2 generally shown by only its outer profile, is supplied to the outlet cylinder 3 of loom 2 which is made so as to be an idle cylinder. The fabric is then supplied to idle cylinders 4, 5 and 6, the arrangement and number of which is neither critical nor essential for a successful product. Finally, the fabric reaches a stationary enlarging cylinder 7 having particular grooves, the arrangement of which is well known in the art, the cylinder being such as to remove any crease or wrinkle which might arise during the preceding travel without imparting any transverse tension to the fabric;

Now, the fabric so smoothed out, will continue its travel until reaching the drive roller 8, provided with an adjustable clutch, conveniently stretching the fabric 1 in the length or section 9 between rollers 7 and 8. Intermediate this length or section 9, there is provided the cutting-sealing device 10 which will be hereinafter described.

After passing on drive roller 8, the fabric cut to ribbons is preferably supplied to a further drive roller 11. In case, either rollers 8 and 11 are drive rollers, provided that the required tension is obtained on length or section 9.

Then, each of the individual ribbons are wound up on bobbins 12 and 13, the latter being staggered to avoid any possible overlapping of the ribbons.

Figure 7:
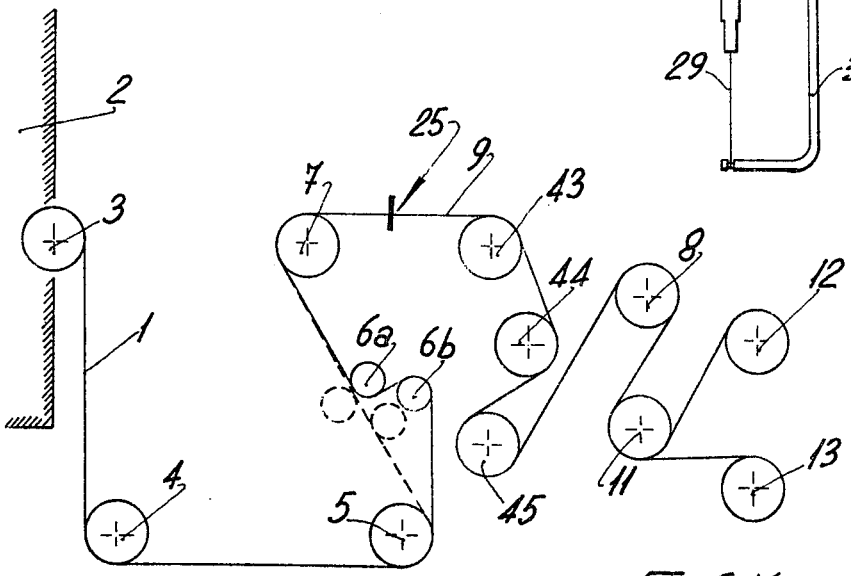
FIG. 7 is another schematic view showing the fabric and ribbon travel from the outlet cylinder of a weaving machine.

The fabric travel could also be that as shown in FIG. 7. Fabric 1 emerges from the weaving machine 2 and is particularly supplied to the outlet roller 3 thereof. The fabric 1 then firstly supplied on two transmission rollers 4 and 5, whereupon the fabric is wound up on a pair of rollers 6*a* and 6*b*, which can be positioned relative to each other so as to cause the fabric to undergo a shorter or longer travel and this in connection with the following discussion relating to timing of cutting position with respect to weaving position. Two further positions 6*a*′ and 6*b*′ for said rollers have been shown by dotted line in which, for example, the fabric follows a shorter travel.

The fabric is then supplied to an enlarging roller 7 stretching the fabric and removing all of the creases eventually existing therein, without producing any tension effect on its height. The fabric is now supplied to a generally flat portion 9, which will be that length or section where the cutting operation will be carried out by means of the cutting-sealing units 25 (or 15) now to be described.

After this cutting and simultaneous sealing operation, the ribbons obtained are supplied to a further roller 43, then wound up on a heated roller 44 carrying out a sort of stretching or ironing of the newly cut ribbon set. In order to assure that the ribbons would perfectly adhere to this heated roller 44, they are supplied to a further transmission roller 45, the latter causing the individual ribbons to perfectly adhere to heated roller 44, whereupon the fabric is wound up on a drive roller 8, or more conveniently on two staggered drive rollers 8 and 11, which are preferably lined with emery cloth or other highly adhering type of material. Finally, each of the cut ribbons are wound up on offset axis rollers 12 and 13.

Usually, it is required that rollers 8 and 11 be both drive rollers and lined with a material having a high friction coefficient relative to the fabric since, when bobbins 12 and 13 are replaced as being full, the individual processing ribbons should remain stretched without unwinding from the associated rollers, or moving thereon.

The pair of rollers 6*a* and 6*b* perform the function of defining the cutting position relative to the configuration of the ribbon pattern to be cut as desired. As above mentioned, this is particularly advantageous when the fabric feeding rate is uneven, since the manufacture would vary depending on the pattern color number. As a matter of fact the fabric feeding is effected whenever providing primary color, whereas for all of the auxiliary colors the fabric will not advance, so that where the pattern involves a plurality of colors, feeding is slower than at those locations where the fabric has no color variations, or where such color variations are minimized. A typical example of fast feeding is that occurring between each label. The fabric cut shall be effected at a location which is just the same as that being provided by the weaving machine. In other words, where the fabric has only one or few colors said fabric is fed rapidly from the weaving machine and has to be cut and sealed rapidly. On the contrary, where the fabric comprises a plurality of wefts and presents therefore an increased thickness, the cutting and sealing operations must also be done slower. By suitably setting said rollers 6*a* and 6*b*, when the production of a determined type of ribbons is started, the length of fabric between the production zone and cutting zone can be correctly adjusted once for all in order that these zones are exactly the same.

Figure 2:
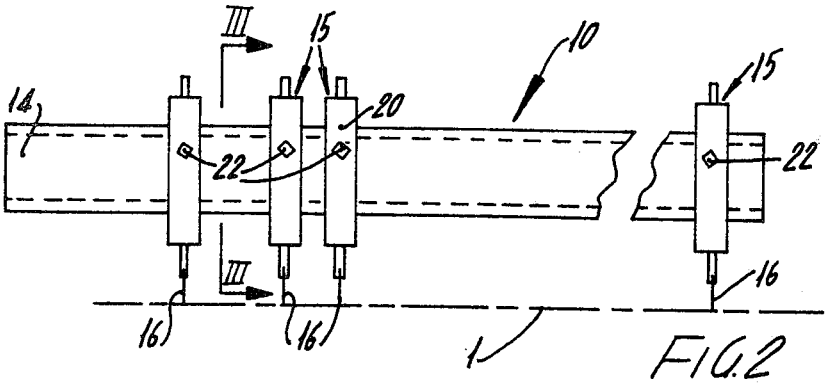
FIG. 2 is a sectional view taken along line II—II of FIG. 1 and showing a first embodiment of a cutting-sealing unit.
Figure 3:
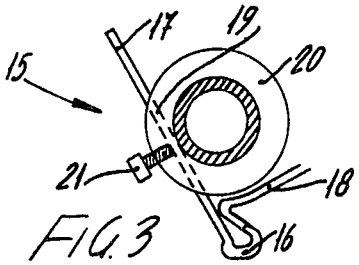
FIG. 3 is a sectional view taken along line III—III of FIG. 2.
Figure 6:
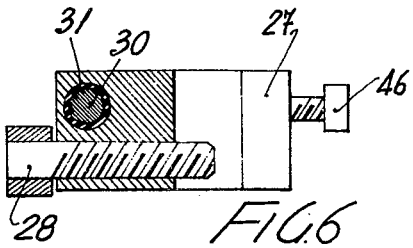
FIG. 6 is a sectional view taken along line VI—VI of FIG. 5.

Referring now to the cutting-sealing device 10, the latter will now be described in connection with FIGS. 2 and 3 for a first simplified solution and in connection with FIGS. 4 to 6 for a more advanced solution. In FIGS. 2 and 3 it can be seen that this device 10 preferably comprises a tube 14 which is herein shown of circular cross-section, but which could be of any shape, and cutting-sealing units 15.

A cutting-sealing unit 15 comprises a blade 16 which is heated to the desired temperature, for example, by electric current flow therethrough. Should end 17 carrying blade 16 be grounded for constructive convenience, then lead or conductor 18 will be insulated and connected with a power supply for supplying a certain current. This current, and hence the temperature of blade 16, will preferably be adjustable, so that also the heating for said blade can be adjusted depending on the type of fabric, the output rate of the fabric, etc. Blade 16 and associated supporting end 17 are slipped into a hole 19 formed in a ring 20 which is assembled for sliding on tube 14 and being clamped thereon at any desired position, for example by means of a set screw 22 resting on the supporting tube 14.

Here, it should readily be noted that the ribbon width merely depends on the spacing between two adjoining units 15 placed on tube 14 and how said spacing can be easily varied for obtaining the desired width of the fabric.

Preferably, the position for blade 16 and associated support 17 sliding within hole 19 of ring 20 is made adjustable so as to provide for the desired depth in fabric 1. This can be done, for example, be sliding said support 17 into hole 19 and then securing it by means of screw 21.

Heating of blade 16 for cutting and sealing (that is for selvage or listing manufacture) the ribbons could be carried out also by other devices: for example, an armored resistance could be introduced into tube 14, so that ring 20 and hence also blade 16 are heated up, or heating could also occur by means of steam, superheated water, diathermic oil, or by causing any other suitable fluid to flow therethrough.

Figure 4:
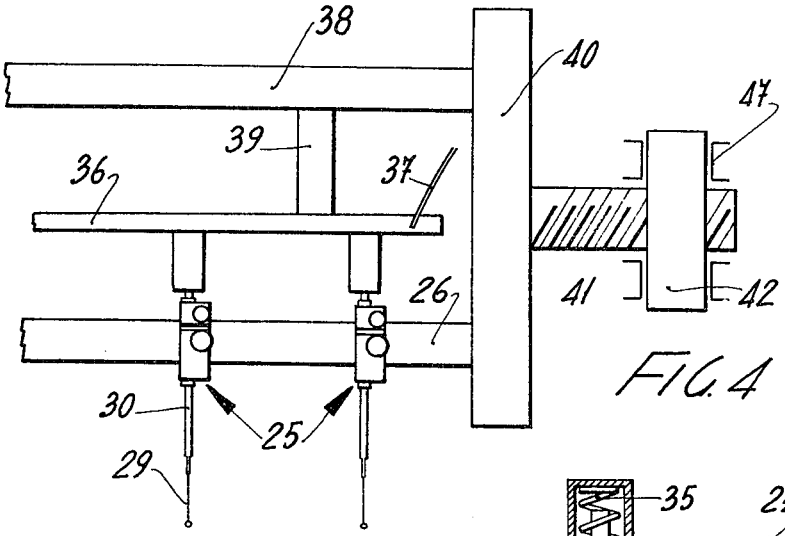
FIG. 4 is a view showing the end of the transverse current carrying rod and cross bar supporting the cutting-sealing units along with the device for simultaneously moving all of the cutting-sealing units transversely of the fabric.
Figure 5:
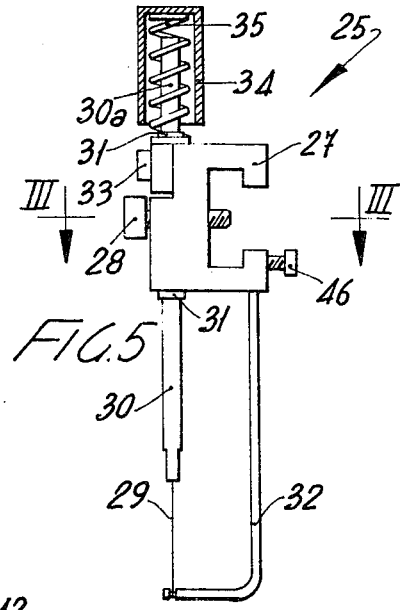
FIG. 5 is a side partly cut away view showing another embodiment of a cutting-sealing unit.

Then, a micrometrical regulation axially of the supporting tube 14 could be provided, which has been more particularly shown in the exemplary embodiment of FIG. 4, in which the cutting-sealing units 25 shown therein are also of improved design. Referring first to FIG. 5, provision was made therein for cutting-sealing units generally designated by reference numeral 25, which are carried by a cross bar 26 penetrating into the C-shaped body or housing 27 thereof (FIG. 5). Each of the individual cutting-sealing units 25 are secured in place on cross bar 26 by means of a pressure screw 28. The actual cutting-sealing member comprises a wire or blade 29 carried at one end by a rod 30 passing through said body or housing 27 and projecting at the top with its end 30*a*, the bore containing it being completely lined with an insulation 31, as clearly shown not only in FIG. 5, but also in the sectional view of FIG. 6.

The other end of cutting wire or blade 29 is connected with a resilient means 32, which is secured to one end of body or housing 27 by means of pressure screw 46. Rod 30 can slide within the bore in body or housing 27 so as to put said blade or wire under tension. On reaching the desired tension, rod 30 will be clamped by means of pressure screw 33.

Preferably, a thin wire having a diameter of 0.25 mm was used.

The end 30*a* of rod 30 is also received within a cap 34 containing a spring 35, the cap sliding on a rod 36 carrying the current which, for example, is supplied by means of a connection 37. Thus, each of the caps 34 can slide and press against the current carrier rod 36, always providing a good contact therewith and accordingly supplying the electric current to cutting blades 29.

Obviously, current carrier rod 36 is supported by a supporting beam 38 by means of insulating mounts 39.

Said supporting beam 38 and cross bar 26 are parallel to each other and interconnected by a plate 40 which is preferably made movable transversely of the fabric feeding by means of a screw 41 and associated nut 42 that can rotate, but not traverse by being confined within a fixed support or bearing schematically designated at 47.

Obviously, the whole foregoing matter can undergo small variations in details, not involving any variations in the base contents of the invention.

What we claim is:

1. In a method of manufacturing a plurality of woven fabric ribbons woven of heat sealable material wherein warp and weft threads of different colors are interwoven with the weft threads being woven transversely into longitudinal warp threads of material which are positively drawn by outlet means through a weaving station to form a woven fabric having a plurality of distinct multi-color patterns across the width thereof separated by narrow selvages formed of heat sealable material, the woven fabric is tensioned transversely while between the outlet means and weaving station, the woven fabric is directed from the outlet means to a receiving station substantially at the velocity at which it is drawn through the weaving station, and the transverse tension on the woven fabric is relaxed between the outlet means and receiving station, the improvement comprising the step of applying sufficient heat to the narrow selvages between the distinct patterns to longitudinally slit and simultaneously seal the fabric in a cutting-sealing zone disposed between the outlet means of the weaving machine and the receiving station and at a location downstream of the outlet when the transverse tension in the fabric is relaxed to provide a plurality of ribbons of the multi-color fabric, each ribbon comprising a longitudinal row of the multi-color patterns, and directing each ribbon to the receiving station from the cutting-sealing zone.

2. In a method as defined in claim 1 including the step of selectively controlling the longitudinal tension in the fabric in the cutting-sealing zone.

3. In a method as defined in claim 2 including the step of selectively controlling the length of the path of movement between the outlet means of the weaving machine and the cutting-sealing zone for controlling the length of the fabric between the weaving station of the weaving machine and the cutting-sealing zone.

4. In an apparatus for manufacturing a plurality of woven fabric ribbons woven of heat sealable material wherein the apparatus includes means for interweaving warp and weft threads of different colors with the weft threads being woven transversely into longitudinal warp threads of material which are postively drawn by outlet means through a weaving station to form a woven fabric having a plurality of distinct multi-color patterns across the width thereof separated by narrow selvages formed of heat sealable material, the woven fabric being tensioned transversely while between the outlet means and weaving station, the woven fabric being directed from the outlet means to a receiving station substantially at the velocity at which it is drawn through the weaving station, and the transverse tension on the woven fabric relaxing between the outlet means and receiving station, the improvement comprising means for applying sufficient heat to the narrow selvages between the distinct patterns to longitudinally slit and simultaneously seal the fabric in a cutting-sealing zone disposed between the outlet means of the weaving machine and the receiving station and at a location downstream of the outlet when the transverse tension in the fabric is relaxed to provide a plurality of ribbons of the multi-color fabric, each ribbon comprising a longitudinal row of the multi-color patterns, and means for directing each ribbon to the receiving station from the cutting-sealing zone.

5. In apparatus as defined in claim 4 including means for applying a longitudinal tension to the fabric web in said cutting-sealing zone.

6. In apparatus as defined in claim 5 wherein said means for applying longitudinal tension to said fabric web in said cutting-sealing zone comprises a pair of rollers spaced apart along the longitudinal path of movement of the fabric web and engageable with the fabric web, and means for selectively controlling the speed of rotation of at least one of said rollers for applying said longitudinal tension.

7. In apparatus as defined in claim 4 including a longitudinally extending support member extending substantially transverse to the direction of movement of the fabric web in the cutting-sealing zone, said means for applying heat to the narrow selvages of said fabric web comprising a plurality of heating elements mounted on said support member and disposed at an angle to the plane of the fabric web in the cutting-sealing zone, and means for selectively adjusting the longitudinal position of said heating elements relative to said support member for adjusting the transverse position of said heating elements relative to said fabric web.

8. An apparatus as defined in claim 7, including means for adjusting the longitudinal position of said support member for adjusting the transverse position of said heating elements and said support member relative to said fabric web.

9. Apparatus as defined in claim 7 wherein each heating element comprises a longitudinally extending thin wire blade, means for supporting said thin wire blade under longitudinal tension, and means for applying an electrical potential to said thin wire blade in said cutting-sealing zone for cutting and sealing the fabric material.

10. Apparatus as defined in claim 9 including means for regulating the electric potential applied to said wire for adjusting the temperature of said thin wire blade.

11. Apparatus as defined in claim 10 including means for grounding one portion of the thin wire blade and means for applying current to another portion thereof, said last mentioned means comprising a current carrier member, means for continuously energizing said current carrier member, a contact member in continuous contact with said thin wire blade, and means for resiliently biasing said contact member into contact with said continuous current carrier member for applying current to said thin wire blade.

12. Apparatus as defined in claim 4 including means for selectively adjusting the length of the path of movement of the fabric between the outlet means and the cutting-sealing zone for controlling the length of the path of movement of the fabric between the weaving station and the means for longitudinally heating the narrow selvages of the fabric web.

* * * * *